US006606867B1

(12) United States Patent
Sienel

(10) Patent No.: US 6,606,867 B1
(45) Date of Patent: Aug. 19, 2003

(54) SUCTION LINE HEAT EXCHANGER STORAGE TANK FOR TRANSCRITICAL CYCLES

(75) Inventor: Tobias H. Sienel, Manchester, CT (US)

(73) Assignee: Carrier Corporation, Syracuse, NY (US)

( * ) Notice: Subject to any disclaimer, the term of this patent is extended or adjusted under 35 U.S.C. 154(b) by 320 days.

(21) Appl. No.: 09/713,122

(22) Filed: Nov. 15, 2000

(51) Int. Cl.[7] ..... F25B 41/00
(52) U.S. Cl. ..... 62/113; 62/513
(58) Field of Search ..... 62/113

(56) References Cited

U.S. PATENT DOCUMENTS

| | | | | | |
|---|---|---|---|---|---|
| 3,327,495 | A | * | 6/1967 | Ergenc | 62/513 |
| 4,030,315 | A | * | 6/1977 | Harnish | 62/513 |
| 4,316,366 | A | * | 2/1982 | Manning | 62/513 |
| 5,095,712 | A | * | 3/1992 | Narreau | 62/513 |
| 5,245,836 | A | | 9/1993 | Lorentzen et al. | |
| 6,182,467 | B1 | * | 2/2001 | Zhong et al. | 62/513 |
| 6,202,438 | B1 | * | 3/2001 | Barito | 62/513 |

FOREIGN PATENT DOCUMENTS

| | | |
|---|---|---|
| JP | 10-019421 | 1/1998 |
| WO | WO99/08053 | 2/1999 |

* cited by examiner

*Primary Examiner*—William E. Tapolcai
(74) *Attorney, Agent, or Firm*—Carlson, Gaskey & Olds

(57) ABSTRACT

A suction line heat exchanger storage tank for use in a vapor compression system to increase the efficiency and capacity of the system. Carbon dioxide is preferably used as the refrigerant. The high pressure of the system (gas cooler pressure) is regulated by adding charge to or removing charge from the system and storing it in a storage tank. The suction line heat exchanger exchanges heat internally between the high pressure hot refrigerant fluid discharged from the gas cooler and the low pressure cool refrigerant vapor discharged from the evaporator. The high pressure is regulated by adjusting valves. A first valve allows excess charge from the system to enter the storage tank if the pressure in the gas cooler is too high. If the pressure in the gas cooler is too low, a second valve is opened to allow excess charge from the storage tank to reenter the system. By regulating the high pressure of the system, the evaporator inlet enthalpy can be controlled to achieve optimal efficiency and/or capacity.

17 Claims, 2 Drawing Sheets

SUCTION LINE HEAT EXCHANGER STORAGE TANK FOR TRANSCRITICAL CYCLES

BACKGROUND OF THE INVENTION

The present invention relates generally to a means for regulating the high pressure component of a transcritical vapor compression system.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run transcritical under most conditions.

When a vapor compression system is run transcritical, it is advantageous to regulate the high pressure component of the system. By regulating the high pressure of the system, the capacity and/or efficiency of the system can be controlled and optimized. Increasing the high pressure of the system (gas cooler pressure) lowers the specific enthalpy at the inlet of the evaporator and increases capacity. However, more energy is expended because the compressor must work harder. It is advantageous to find the optimal high pressure of the system, which changes as operating conditions change. By regulating the high pressure component of the system, the optimal high pressure can be selected.

Hence, there is a need in the art for a means for regulating the high pressure component of a transcritical vapor compression system.

SUMMARY OF THE INVENTION

The present invention relates to a means for regulating the high pressure component of a transcritical vapor compression system.

A vapor compression system consists of a compressor, a heat rejection heat exchanger, an expansion device, and a heat absorbing heat exchanger. A suction line heat exchanger (SLXH) is employed to increase the efficiency and/or capacity of the system and prevent ingestion of liquid refrigerant into the compressor. In this preferred embodiment of the invention, carbon dioxide is used as the refrigerant. This invention uses this type heat of exchanger to regulate the high pressure component.

This invention regulates the high pressure component of the vapor compression (pressure in the gas cooler) by removing or delivering charge to/from the system and storing it in a storage tank of the suction line heat exchanger. A suction line heat exchanger exchanges heat internally between the high pressure hot fluid refrigerant discharged from the gas cooler (heat rejection heat exchanger) and the low pressure cool vapor refrigerant discharged from the evaporator (heat absorbing heat exchanger). There is a volume in these heat exchangers which is used by this invention to store refrigerant.

The high pressure in the gas cooler is regulated by adjusting valves in the suction line heat exchanger. A first valve allows excess charge from the gas cooler to flow into the storage tank if the gas cooler pressure is too high. If the gas cooler pressure is too low, a second valve is opened to release charge from the storage tank back into the system. By controlling the actuation of the valves, the high pressure component of the system can be regulated to achieve optimal efficiency and/or capacity.

Accordingly, the present invention provides a method and system for regulating the high pressure component of a transcritical vapor compression system.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
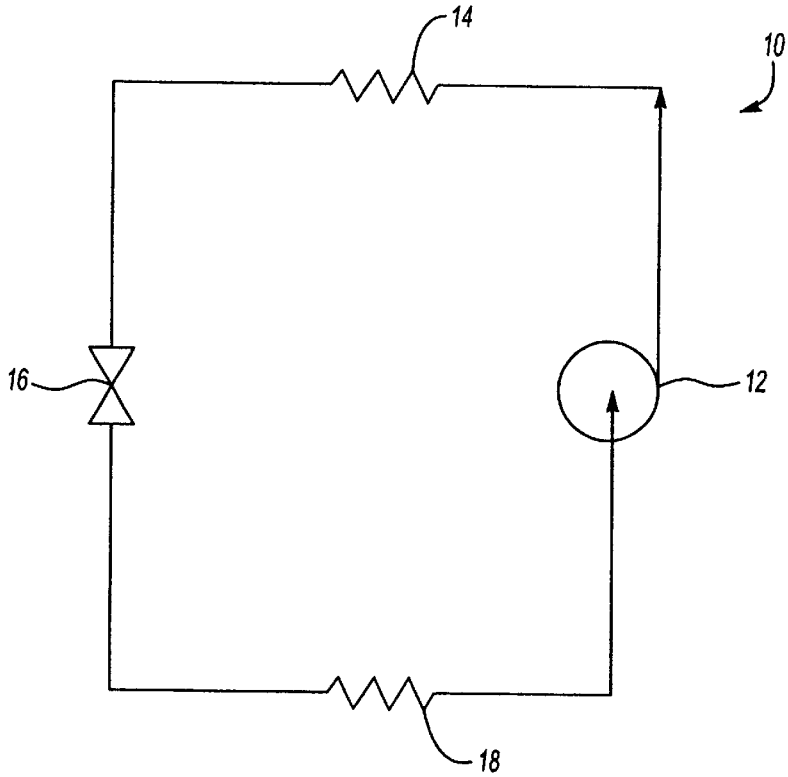
Fig-1 PRIOR ART
FIG. 1 illustrates a schematic diagram of a prior art vapor compression system.

While the invention may be susceptible to embodiments in different forms, there is shown in the drawings, and herein will be described in detail, specific embodiments with the understanding that the present disclosure is to be considered an exemplification of the principles of the invention, and is not intended to limit the invention to that as illustrated and described herein.

FIG. 1 illustrates a prior art vapor compression system 10. A basic vapor compression system 10 consists of a compressor 12, a heat rejecting heat exchanger (a gas cooler in transcritical cycles) 14, an expansion device 16, and a heat accepting heat exchanger (an evaporator) 18.

Refrigerant is circulated though the closed circuit cycle 10. In a preferred embodiment of the invention, carbon dioxide is used as the refrigerant. While carbon dioxide is illustrated, other refrigerants may be used. Because carbon dioxide has a low critical point, systems utilizing carbon dioxide as a refrigerant usually require the vapor compression system 10 to run transcritical.

When the system 10 is run transcritical, it is advantageous to regulate the high pressure component of the vapor compression system 10. By regulating the high pressure of the system 10, the capacity and/or efficiency of the system 10 can be controlled and optimized. Increasing the gas cooler 14 pressure lowers the enthalpy entering the evaporator 18 and increases capacity, but also requires more energy because the compressor 16 must work harder. By regulating the high pressure of the system 10, the optimal pressure of the system 10, which changes as the operating conditions change, can be selected.

Figure 2:
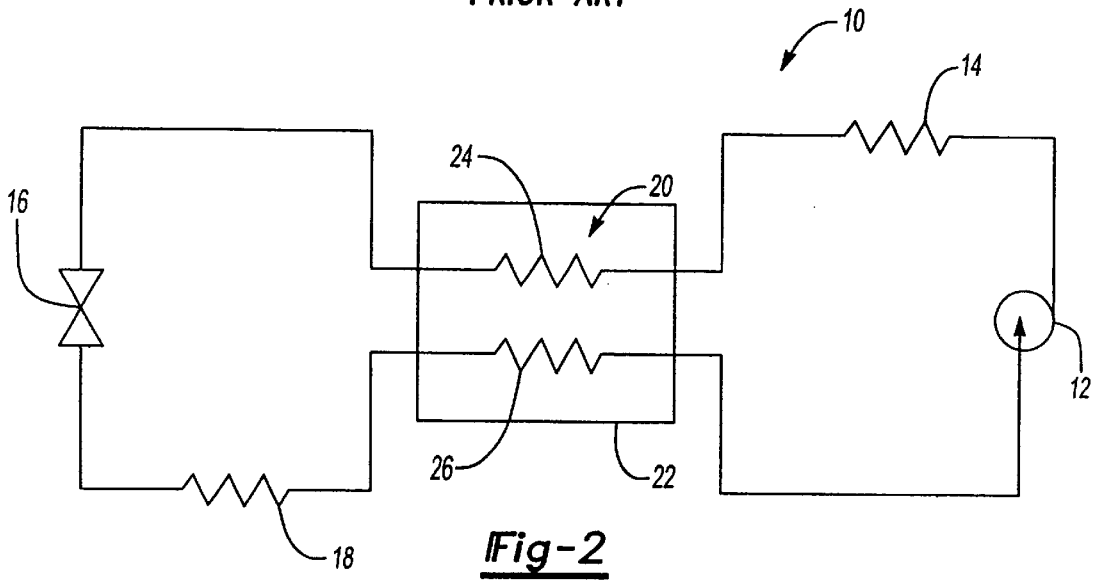
Fig-2 PRIOR ART
FIG. 2 illustrates a schematic diagram of a vapor compression system utilizing a suction line heat exchanger as known.

FIG. 2 illustrates a vapor compression system 10 employing a suction line heat exchanger (SLHX) 20. The suction line heat exchanger 20 increases the efficiency and/or capacity of the vapor compression system 10, and prevents ingestion of liquid refrigerant into the compressor 12, which can be detrimental to the system 10.

This invention regulates the high pressure component of the vapor compression system 10 to achieve the optimal pressure by adding excess charge to or removing excess charge from the system 10 and storing it in the suction line heat exchanger 20 storage tank 22. By regulating the high pressure in the gas cooler 14 before expansion, the enthalpy of the refrigerant at the entry of the evaporator can be modified, controlling the capacity of the system 10.

Figure 3:
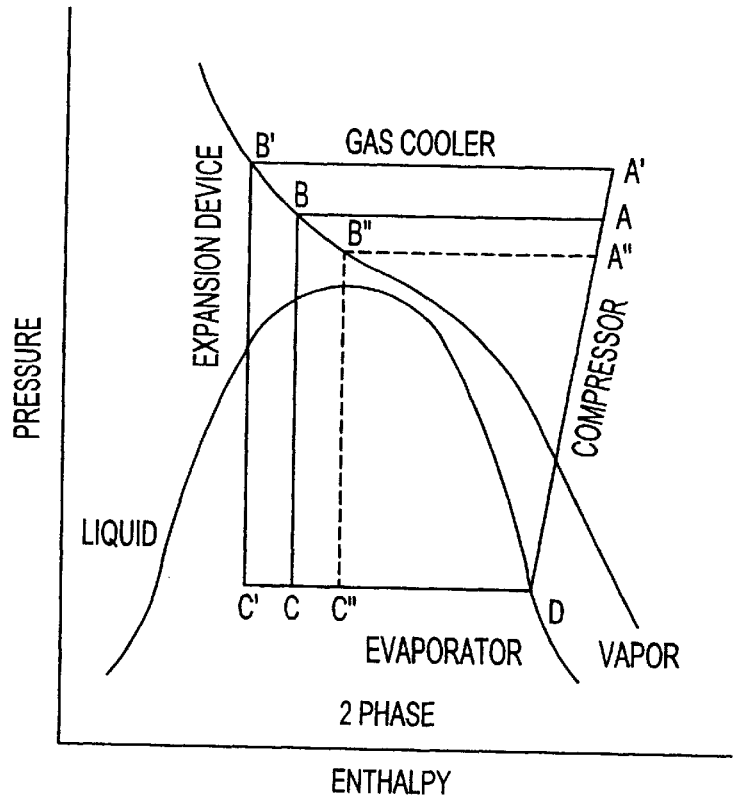
FIG. 3 illustrates a thermodynamic diagram of a transcritical vapor compression system.

In a cycle of the vapor compression system 10 employing a suction line heat exchanger 20, the refrigerant exits the compressor 12 at high pressure and enthalpy, shown by point A in FIG. 3. As the refrigerant flows through the gas cooler 14 at high pressure, it loses heat and enthalpy, exiting the gas cooler 14 with low enthalpy and high pressure, indicated as point B. The hot refrigerant fluid passes through the suction line heat exchanger 20 before entering the expansion device 16. The refrigerant travels through the storage tank 20 along a first conduit 24 which connects the exit of the gas cooler 14 to the entry of the expansion device 16. As the refrigerant passes through the expansion device 16, the pressure drops, shown by point C. After expansion, the refrigerant passes through the evaporator 18 and exits at a high enthalpy and low pressure, represented by point D. The cool vapor refrigerant then reenters the storage tank 22 and travels along a second conduit 26 which connects the exit of the evaporator 18 to the entry of the compressor 12. After the refrigerant passes through the compressor 12, it is again at high pressure and enthalpy, completing the cycle.

The suction line heat exchanger 20 exchanges heat internally between the high pressure hot refrigerant fluid discharged from the gas cooler 14 and the low pressure cool refrigerant vapor discharged from the evaporator 18. The pressure in the storage tank 22 is intermediate to the high and low pressures of the system.

Figure 4:
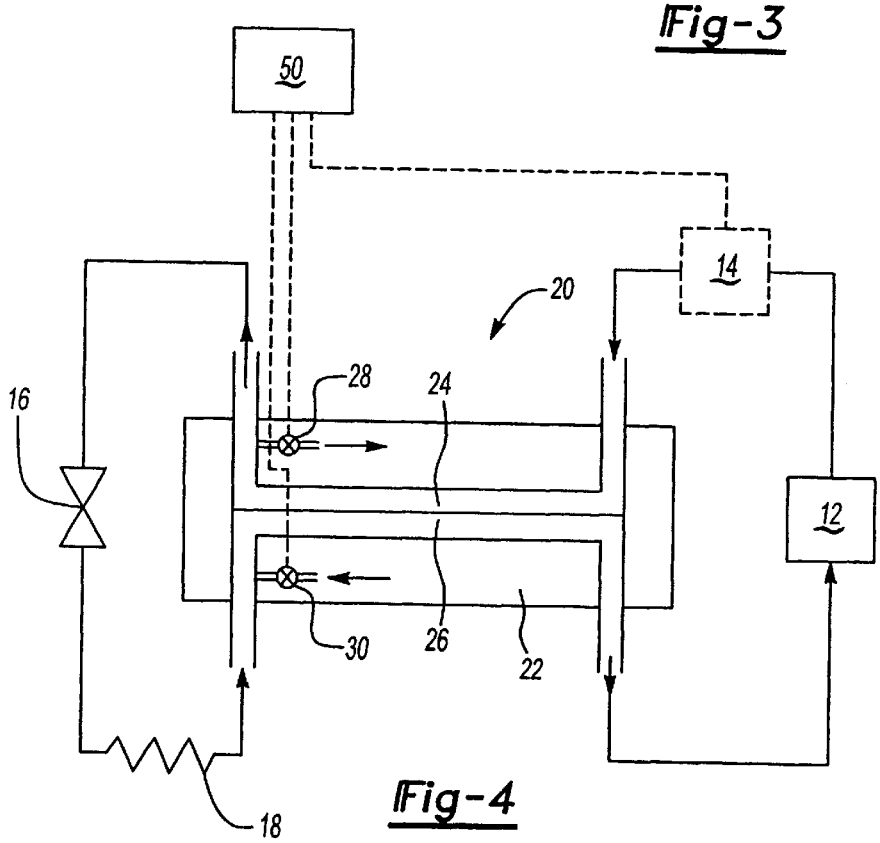
FIG. 4 illustrates a schematic diagram of a storage tank of a suction line heat exchanger used with a transcritical vapor compression system.

As shown in FIG. 4, the pressure in the gas cooler 14 is regulated by adjusting valves 28 and 30 in the suction line heat exchanger 20. The first valve 28 is located in the storage tank 22 along the first conduit 24, and the second valve 30 is located in the storage tank 22 along the second conduit 26.

A control 50 senses pressure in the cooler 14 and controls valves 28 and 30. The control 50 may be the main control for cycle 10. Control 50 is programmed to evaluate the state the cycle 10 and determine a desired pressure in cooler 14. Once a desired pressure has been determined, the valves 28 and 30 are controlled to regulate the pressure. The factors that would be used to determine the optimum pressure are within the skill of a worker in the art.

When the pressure in the gas cooler 14 is higher than desirable, too much energy is needed to run the system. If control 50 determines the pressure is higher than desired, the first valve 28 is opened to allow charge from the gas cooler 14 to enter the storage tank 22, decreasing the pressure in the gas cooler 14 from A to A' (shown in FIG. 3), requiring less energy to run the system. The refrigerant then enters the evaporator 18 at a higher enthalpy, represented by point C' in FIG. 3.

Conversely, if the pressure in the gas cooler 14 pressure is lower than desirable, the system is not running at maximum capacity. If control 50 determines the pressure is lower then desirable, the second valve 30 is opened and charge from the storage tank 22 flows back into the system 10 to increase capacity. The gas cooler 14 pressure increases from A to A' and the refrigerant reenters the evaporator 18 at a lower enthalpy, shown by point C' in FIG. 3. By regulating the high pressure component of the system 10 to the optimum pressure, the enthalpy can be modified to achieve optimal capacity.

Control 50 is preferably a microprocessor based control or other known controls such as known in the art of refrigerant cycles. While the actuation of the first valve 28 and the second valve 30 can be controlled actively by a control, it could also be controlled passively, such as by pressure relief valves 28 and 30. By controlling the actuation the valves 28 and 30, the high pressure in the gas cooler 14 can be optimally set and controlled, increasing the cooling capacity of the system 10.

In the preferred embodiment, the storage tank 22 is long and of a small diameter. Since the wall thickness of the storage tank 22 is a finction of diameter, the tank should be of a small diameter 36 to reduce weight.

There are several advantages to storing excess charge of the system 10 in a combined suction line heat exchanger 20. Since the discharge from both the gas cooler 14 and the evaporator 18 share a storage tank 22, the number of parts is reduced, resulting in lower manufacturing costs and higher reliability.

Accordingly, the present invention provides a suction line heat exchanger 20 which provides a means for controlling the high pressure in a transcritical vapor compression system 10.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A suction line heat exchanger for regulating a high pressure of a refrigerant circulating in a transcritical vapor compression system comprising:

a storage tank for storing charge;

a first conduit passing though said storage tank connecting a heat rejecting heat exchanger to an expansion device, said refrigerant traveling through said first conduit at a high pressure;

a second conduit passing through said storage tank connecting a heat accepting heat exchanger to a compression device, said refrigerant traveling though said second conduit at a low pressure;

a first valve located on said first conduit to regulate flow of said charge into said storage tank, said first valve actuated by a controller monitoring said high pressure; and a second valve located on said second conduit to regulate flow of said charge out of said storage tank, said second valve actuated by said controller monitoring said high pressure.

2. The suction line heat exchanger as recited in claim 1 wherein decreasing said high pressure is achieved by actuating said first valve to regulate flow of said charge from said system into said storage tank.

3. The suction line heat exchanger as recited in claim 1 wherein increasing said high pressure is achieved by actuating said second valve to regulate flow of said charge from storage tank into said system.

4. The suction line heat exchanger as recited in claim 1 wherein said high pressure is controlled by actuating said first valve and said second valve.

5. The suction line heat exchanger as recited in claim 4 wherein said first valve and said second valve are controlled by an active control which is provided with feedback from said heat rejecting heat exchanger, and determines a desired pressure at said heat rejecting heat exchanger, and controls said valves to achieve said desired pressure.

6. The suction line heat exchanger as recited in claim 1 wherein said refrigerant is carbon dioxide.

7. A transcritical vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant; and a suction line heat exchanger for regulating said high pressure of said refrigerant comprising a storage tank for storing charge, a first conduit connecting said heat rejecting heat exchanger to said expansion device, a second conduit connecting said heat accepting heat exchanger to said compression device, a first valve located on said first conduit to regulate flow of said charge into said storage tank, and a second valve located on said second conduit to regulate flow of said charge out of said storage tank.

8. The system as recited in claim 7 wherein decreasing said high pressure is achieved by actuating said first valve to regulate flow of said charge from said system into said storage tank.

9. The system as recited in claim 7 wherein increasing said high pressure is achieved by actuating said second valve to regulate flow of said charge from storage tank into said system.

10. The system as recited in claim 7 wherein said high pressure is controlled by actuating said first valve and said second valve.

11. The system as recited in claim 10 wherein said first valve and said second valve are controlled by an active control which is provided with feedback from said heat rejecting heat exchanger, and determines a desired pressure at said heat rejecting heat exchanger, and controls said valves to achieve said desired pressure.

12. The suction line heat exchanger, as recited in claim 7 wherein said refrigerant is carbon dioxide.

13. A method of regulation of a high pressure of a transcritical vapor compression system comprising the steps of:

compressing a refrigerant to said high pressure;

cooling said refrigerant;

passing said refrigerant though a first conduit in a suction line heat exchanger storage tank, said first conduit having a first valve to regulate flow of said charge into said storage tank;

expanding said refrigerant;

evaporating said refrigerant;

passing said refrigerant though a second conduit in a suction line heat exchanger storage tank, said second conduit having a second valve to regulate flow of said charge out of said storage tank; and controlling said high pressure of said refrigerant by actuating said first valve and said second valve.

14. The method as recited in claim 13 wherein the step of controlling said high pressure comprises actuating said first valve to regulate flow of said charge from said system into said storage tank to decrease said high pressure.

15. The method as recited in claim 13 wherein the step of controlling said high pressure comprises actuating said second valve to regulate flow of said charge from storage tank into said system to increase said high pressure.

16. The method as recited in claim 15 wherein said first valve and said second valve are controlled by an active control which is provided with feedback from said heat rejecting heat exchanger, and determines a desired pressure at said heat rejecting heat exchanger, and controls said valves to achieve said desired pressure.

17. The method as recited in claim 13 wherein the refrigerant is carbon dioxide.

* * * * *